US005502849A

United States Patent [19]

Mitchell

[11] Patent Number: 5,502,849

[45] Date of Patent: Apr. 2, 1996

[54] BED ASSEMBLY WITH A YOUTH BED BENEATH AND CRIB ABOVE

[76] Inventor: Joann Mitchell, 119½ S. 10th St., Richmond, Ind. 47374

[21] Appl. No.: 254,510

[22] Filed: Jun. 6, 1994

[51] Int. Cl.[6] ..... A47D 7/00

[52] U.S. Cl. ..... 5/9.1; 5/93.1

[58] Field of Search ..... 5/2.1, 9.1, 93.1, 5/425

[56] References Cited

U.S. PATENT DOCUMENTS

| | | | |
|---|---|---|---|
| 378,455 | 2/1888 | Morse | 5/9.1 |
| 2,855,791 | 9/1941 | Klopfer | 5/93.1 |
| 3,146,736 | 9/1964 | Hetrick | 5/93.1 |
| 3,610,716 | 10/1971 | Weinberg | 5/93.1 |
| 3,930,699 | 1/1976 | Schinzlein | 5/9.1 |

FOREIGN PATENT DOCUMENTS

| | | | |
|---|---|---|---|
| 957876 | 2/1950 | France | 5/93.1 |
| 601610 | 8/1934 | Germany | 5/93.1 |
| 3008336 | 9/1981 | Germany | 5/93.1 |
| 213127 | 3/1924 | United Kingdom | 5/9.1 |

*Primary Examiner*—Flemming Saether

[57] ABSTRACT

A bed assembly with a youth bed beneath and crib above comprising: a plurality of corner posts positioned in a vertical orientation to define a rectangular space therebetween for a youth bed beneath and crib thereabove; lower planks coupled with respect to the posts adjacent to the lower extents thereof, the lower planks including long side walls and a short head and foot wall, with support rails facing each other on the interior surfaces of the long side walls; intermediate planks coupled with respect to the posts adjacent at an intermediate location, the intermediate planks including long side walls and a short head and foot wall, with support rails facing each other on the interior surfaces of the long side walls; an upper rail fixedly secured to the plurality of corner posts adjacent to the upper extents thereof along the two short sides and one long side; vertically extending dowels secured between the upper rail and the intermediate planks to define three fixed sides of the crib; a vertically shiftable wall positionable between an upper orientation to define a safe crib thereadjacent, the shiftable wall having an upper horizontal post, a lower horizontal post and vertical dowels therebetween, a pair of guiding eyelets extending outwardly from the upper edge and the lower edge of the shiftable wall; support members facing inwardly from the posts in the region receiving the shiftable wall; and a pair of rods fixedly secured by the securement members and shiftablely receiving the sliding members in reciprocating relationship therewith.

3 Claims, 4 Drawing Sheets

BED ASSEMBLY WITH A YOUTH BED BENEATH AND CRIB ABOVE

BACKGROUND OF THE INVENTION

1. Field of the Invention

The present invention relates to a bed assembly with a youth bed beneath and crib above and more particularly pertains to constructing beds in restricted space with a crib at an elevated orientation and a youth bed in lower orientation in a bunk fashion.

2. Description of the Prior Art

The use of youth beds and cribs of various constructions including bunk-type construction is known in the prior art. More specifically, youth beds and cribs of various constructions including bunk-type construction heretofore devised and utilized for the purpose of constructing beds in a bunk fashion for conservation of space, with the beds being of a wide variety of designs and configuration are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,201,085 to Shamie a crib with drop side lock.

U.S. Pat. No. 5,146,631 to Deal discloses a convertible crib, toddler and twin bed.

U.S. Pat. No. 5,038,427 to Golden discloses a convertible crib-youth bed.

U.S. Pat. No. 4,189,796 to Gutner discloses a adjustable mechanism for guard rail of a bunk bed.

U.S. Pat. No. 3,821,822 to Borreggine discloses a combination cradle, crib and youth bed.

In this respect, the bed assembly with a youth bed beneath and crib above according to the present invention substantially departs from the conventional concepts and designs of the prior art, and in doing so provides an apparatus primarily developed for the purpose of constructing beds in restricted space with a crib at an elevated orientation and a youth bed in lower orientation in a bunk fashion.

Therefore, it can be appreciated that there exists a continuing need for new and improved bed assembly with a youth bed beneath and crib above which can be used for constructing beds in restricted space with a crib at an elevated orientation and a youth bed in lower orientation in a bunk fashion. In this regard, the present invention substantially fulfills this need.

SUMMARY OF THE INVENTION

In view of the foregoing disadvantages inherent in the known types of youth beds and cribs of various constructions including bunk-type construction now present in the prior art, the present invention provides an improved bed assembly with a youth bed beneath and crib above. As such, the general purpose of the present invention, which will be described subsequently in greater detail, is to provide a new and improved bed assembly with a youth bed beneath and crib above and method which has all the advantages of the prior art and none of the disadvantages.

To attain this, the present invention essentially comprises a bed assembly with a youth bed beneath and crib above comprising, in combination: four corner posts positioned in a vertical orientation to define a rectangular space therebetween for a youth bed beneath and crib thereabove; lower planks coupled with respect to the posts adjacent to the lower extents thereof, the lower planks including long side walls and a short head and foot wall, with support rails facing each other on the interior surfaces of the long side walls and a plurality of removable slats positioned thereon; intermediate planks coupled with respect to the posts adjacent at an intermediate location, the intermediate planks including long side walls and a short head and foot wall, with support rails facing each other on the interior surfaces of the long side walls and a plurality of removable slats positioned thereon; an upper rail fixedly secured to the four corner posts adjacent to the upper extents thereof along the two short sides and one long side; vertically extending dowels secured between the upper rail and the intermediate planks to define three fixed sides of the crib; a vertically shiftable wall positionable between an upper orientation to define a safe crib thereadjacent, the shiftable wall having an upper horizontal post, a lower horizontal post and vertical dowels therebetween, a pair of guiding eyelets extending outwardly from the upper edge and the lower edge of the shiftable wall; support eyelets facing inwardly from the posts in the region receiving the shiftable wall; a pair of rods fixedly secured by the securement eyelets and shiftablely receiving the sliding eyelets in reciprocating relationship therewith; and a slidable locking bolt secured to the lower horizontal support of the shiftable wall, the bolt being positionable interiorly retracted when shifting the shiftable wall and movable outwardly to a lock orientation with the head of the bolt secured to an aperture in the adjacent corner posts.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangments of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved bed assembly with a youth bed beneath and crib above which have all the advantages of the prior art youth beds and cribs of various constructions including bunk-type construction and none of the disadvantages.

It is another object of the present invention to provide new and improved bed assembly with a youth bed beneath and crib above which may be easily and efficiently manufactured and marketed.

It is further object of the present invention to provide new and improved bed assembly with a youth bed beneath and crib above which are of durable and reliable constructions.

An even further object of the present invention is to provide new and improved bed assembly with a youth bed beneath and crib above which are susceptible of a low cost of manufacture with regard to both materials and labor, and which accordingly are then susceptible of low prices of sale to the consuming public, thereby making such bed assembly with a youth bed beneath and crib above economically available to the buying public.

Still yet another object of the present invention is to provide new and improved bed assembly with a youth bed beneath and crib above which provide in the apparatuses and methods of the prior art some of the advantages thereof, while simultaneously overcoming some of the disadvantages normally associated therewith.

Still another object of the present invention is to construct beds in restricted space with a crib at an elevated orientation and a youth bed in lower orientation in a bunk fashion.

Lastly, it is an object of the present invention to provide new and improved bed assembly with a youth bed beneath and crib above comprising: a plurality of corner posts positioned in a vertical orientation to define a rectangular space therebetween for a youth bed beneath and crib thereabove; lower planks coupled with respect to the posts adjacent to the lower extents thereof, the lower planks including long side walls and a short head and foot wall, with support rails facing each other on the interior surfaces of the long side walls; intermediate planks coupled with respect to the posts adjacent at an intermediate location, the intermediate planks including long side walls and a short head and foot wall, with support rails facing each other on the interior surfaces of the long side walls an upper rail fixedly secured to the plurality of corner posts adjacent to the upper extents thereof along the two short sides and one long side; vertically extending dowels secured between the upper rail and the intermediate planks to define three fixed sides of the crib; a vertically shiftable wall positionable between an upper orientation to define a safe crib thereadjacent, the shiftable wall having an upper horizontal post, a lower horizontal post and Vertical dowels therebetween, a pair of guiding eyelets extending outwardly from the upper edge and the lower edge of the shiftable wall; support members facing inwardly from the posts in the region receiving the shiftable wall; and a pair of rods fixedly secured by the securement members and shiftablely receiving the sliding members in reciprocating relationship therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
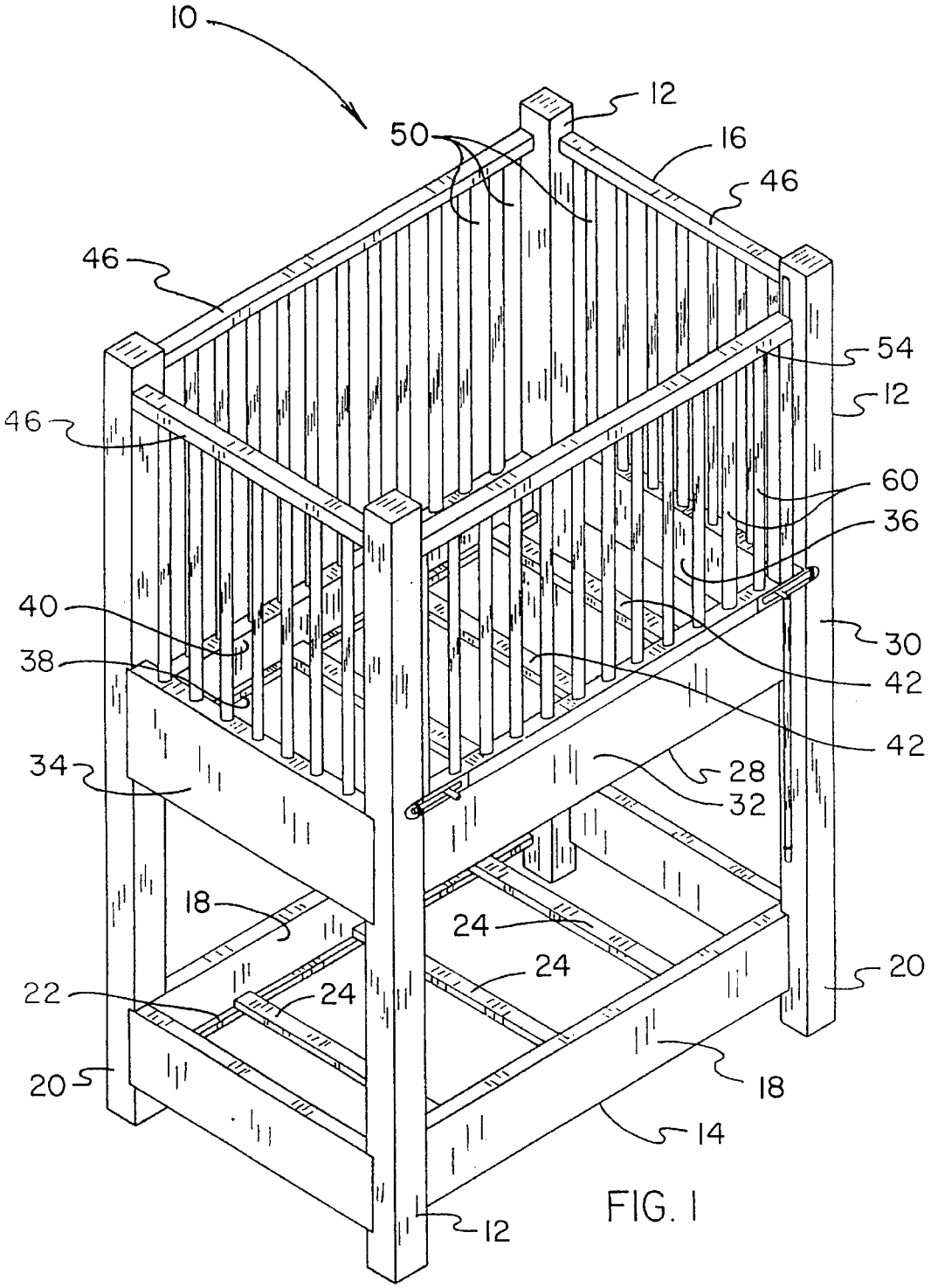
FIG. 1 is a perspective illustration of the preferred embodiment of the bed assembly with a youth bed beneath and crib above constructed it, accordance with the principles of the present invention.
Figure 2:
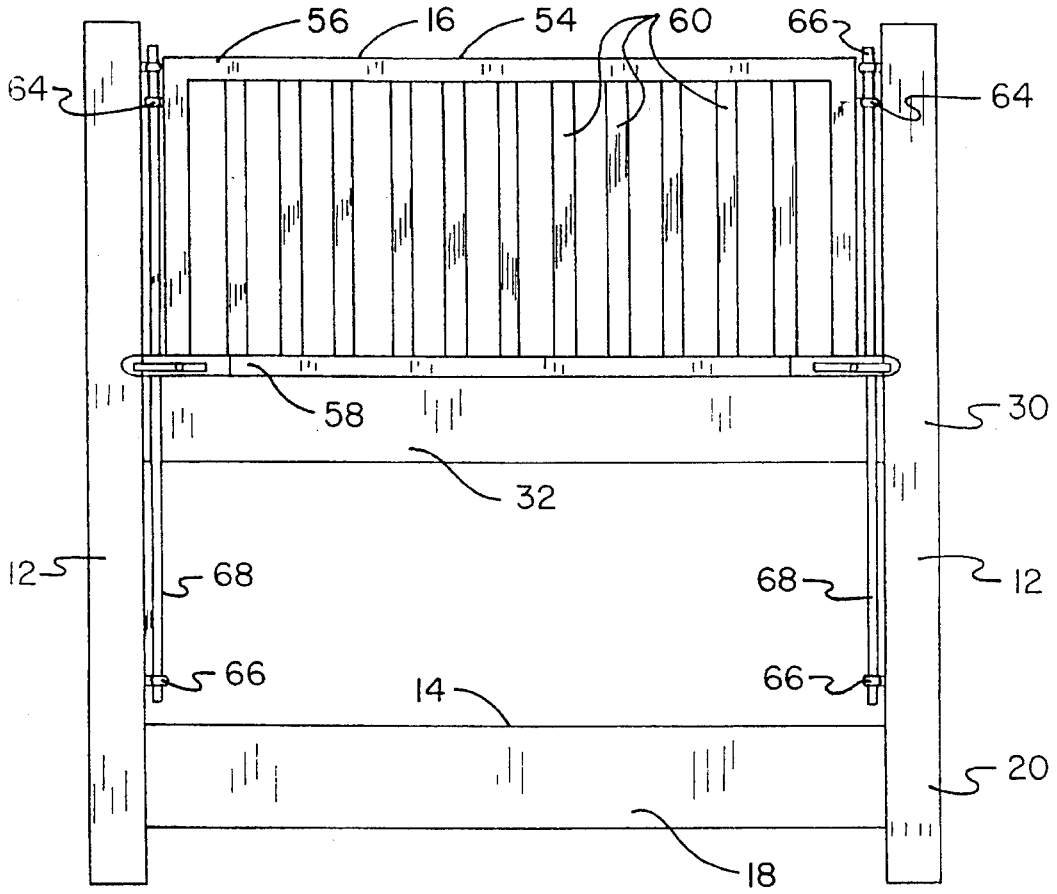
FIG. 2 is a side elevational view of the bed illustrated in FIG. 1.
Figure 3:
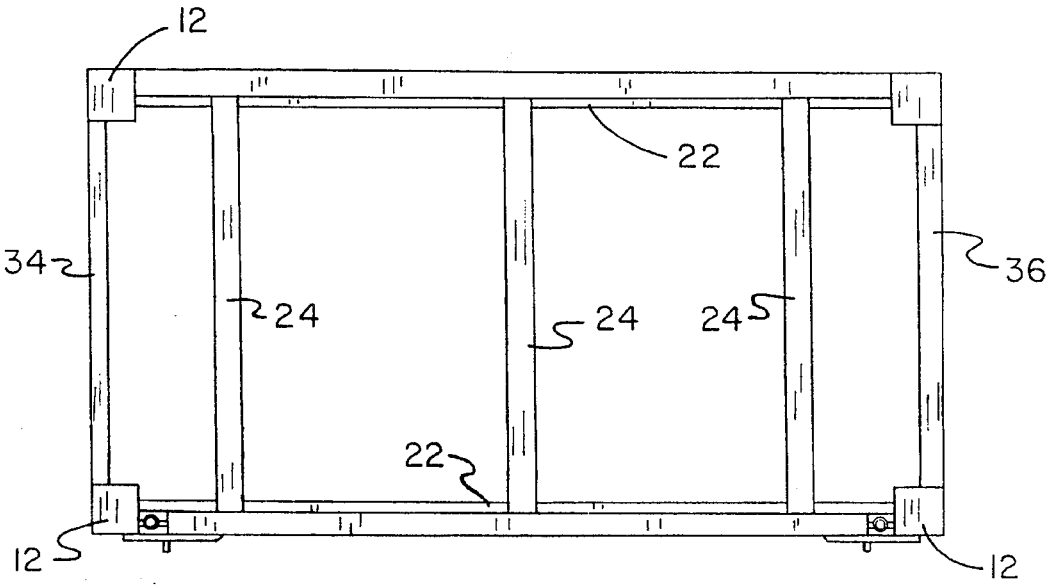
FIG. 3 is a top elevational view of the bed shown in FIGS. 1 and 2.
Figure 4:
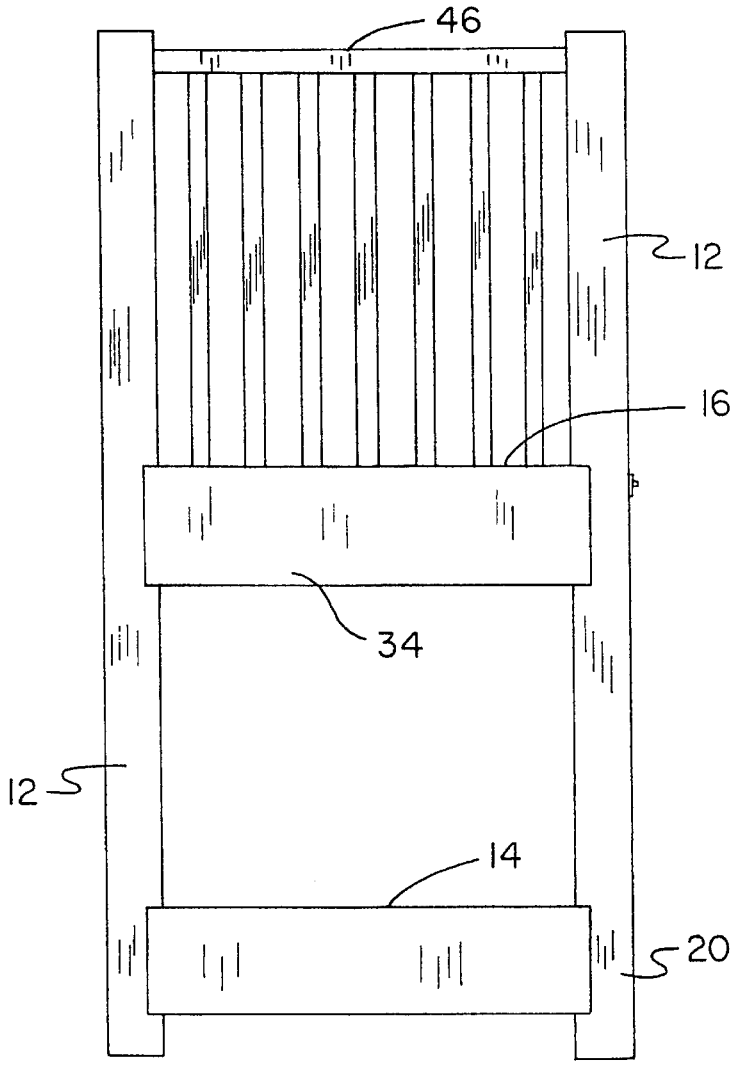
FIG. 4 is an end elevational view of the bed shown in FIGS. 1, 2 and 3.
Figure 5:
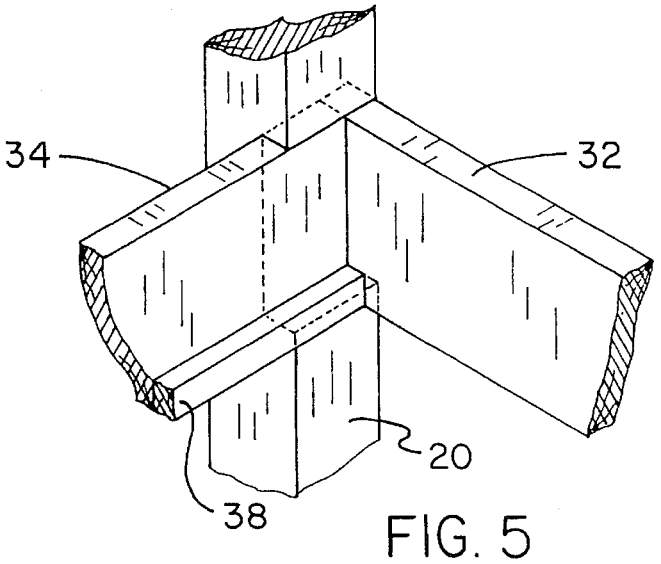
FIG. 5 is a perspective illustration of the coupling of the various horizontal and vertical components of the bed of the prior figure.
Figure 6:
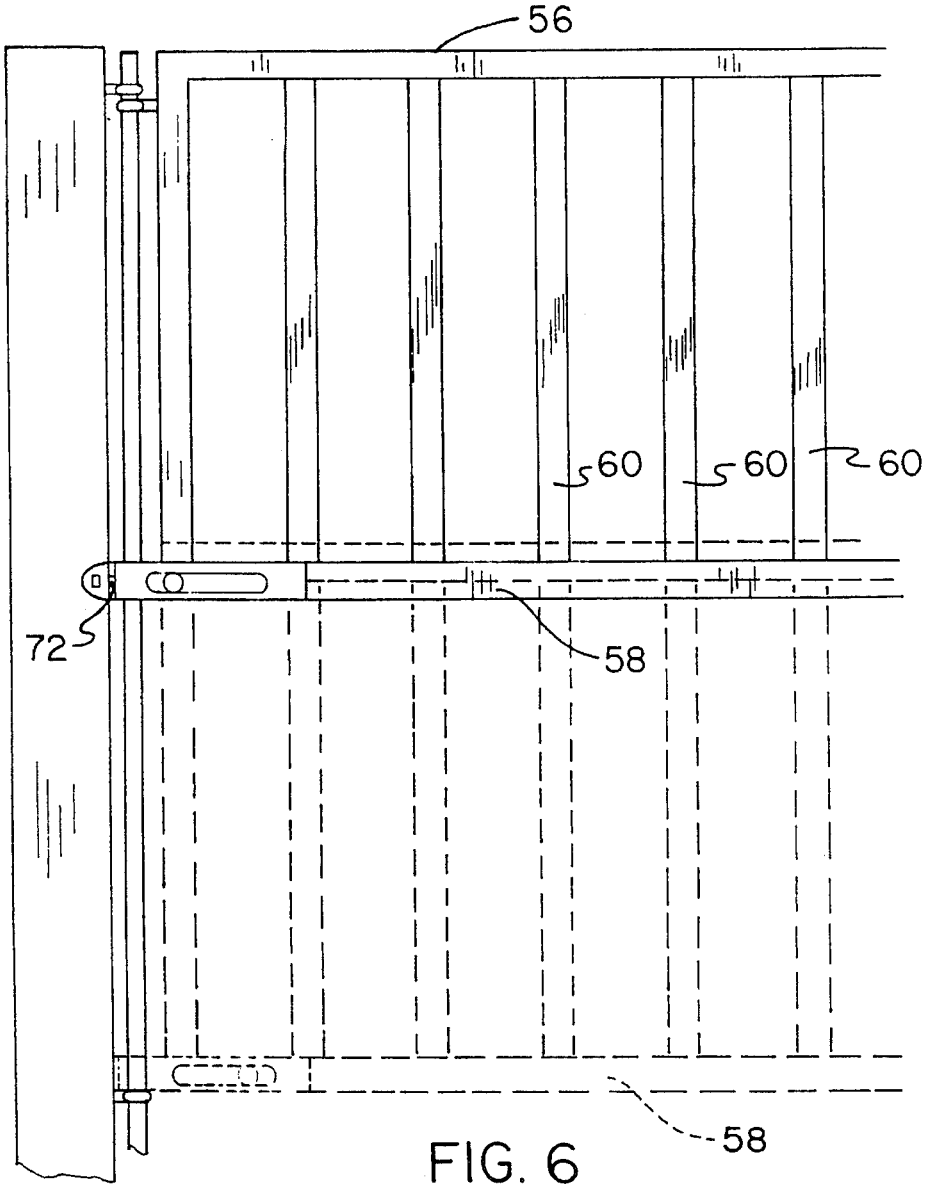
FIG. 6 is an enlarged showing of the coupling and locking components of the side panel and bed.
Figure 7:
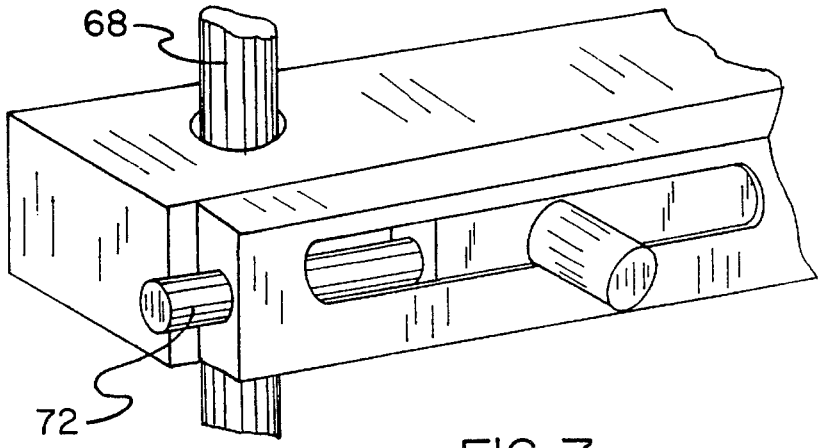
FIG. 7 is a perspective illustration of the locking components illustrated in FIGS. 1, 2, 3 and 6.

With reference now to the drawings, and in particular to FIG. 1 thereof, the preferred embodiment of the new and improved bed assembly with a youth bed beneath and crib above embodying the principles and concepts of the present invention and generally designated by the reference numeral 10 will be described.

The invention, the new and improved bed assembly with a youth bed beneath and crib above is comprised of a plurality of components. In their broadest context, such components include corner posts, lower planks, intermediate planks, an upper rail, dowels, a shiftable wall, support eyelets, securement eyelets, a pair of slide rods and a shiftable locking bolt. Such components are specifically configured and correlated with respect to each other so as to attain the desired objective.

More specifically, the system 10 of the present invention has as its central components, four corner rails 12. Such corner rails are positioned in a vertical orientation in a rectangular configuration. They define a rectangular base between the posts. Such base is for the receipt of a youth bed 14 therebeneath and a crib 16 thereabove.

Next provided are a pair of lower planks 18. The lower planks are coupled at theist ends with respect to the posts adjacent to their lower extents 20. The lower planks include long sidewalls and a short head wall and a short foot wall. The long sidewalls also include a pair of support rails 22. The support rails face each other on the interior surfaces of the long walls. In addition, a plurality of removable slats 24 are positioned on the support rails.

Above the lower planks are a plurality of intermediate planks 28. Such intermediate planks are parallel with the lower planks. The intermediate planks are coupled with respect to the posts adjacent to an intermediate location 30 between the upper and lower ends thereof. The intermediate planks include sidewalls 32 and a short headwall 34 and footwall 36. In addition, support rails 38 are provided to face each other on the interior surfaces 40 of the long sidewalls. In addition, a plurality of removable slats 42 are positioned thereon.

Above the lower planks and intermediate planks there are provided a plurality of upper rails 46. The upper rails are secured at their ends to the four corner posts adjacent to their upper extents. Such rails are located along the two short sides and one long side, the long side to the rear of the system.

Safety is provided to the crib at the upper extent of the system through the use of a plurality of vertically extending parallel dowels 50. Such dowels are located between the upper rails and the intermediate planks therebeneath. As a result, three fixed sides are provided fur the crib at the head end, foot end and one long side to the rear of the system.

On the long side of the crib opposite from the long fixed side, there is located a vertically shiftable wall 54. Such shiftable wall is positioned between an upper orientation to define a safe crib thereadjacent. Such shiftable wall has an upper horizontal post 56 and a lower horizontal post 58 therebeneath. In addition, the vertical dowels 60 are fixedly positioned between the upper and lower horizontal posts.

Movement of the vertical shiftable wall is effected through a plurality of interrelated components. Such interrelated components include a pair of guiding eyelets 64 extending laterally outward from the upper edges and the lower edges of the shiftable wall. In association with the guiding eyelets are two pair of support eyelets 66. The support eyelets face inwardly from the four corner posts in the region of the crib at which the shiftable wall is located. Cooperably related with the guiding eyelets and the support eyelets are a pair of guiding rods 68. Each rod is fixedly secured by a pair of securement eyelets to be located parallel with the adjacent corner posts facing inwardly with respect to each other. Each rod is supported at its opposite ends by the support eyelets. The area between the support eyelets is for shiftably receiving the sliding eyelets with the shiftable wall in reciprocating relationship with the rods and corner posts.

Securement of the shiftable wall to the upper secure position if effected through a slidable locking bolt 72. Such bolt is secured to a lower horizontal support of the shiftable wall. The bolt may be retracted to an interior orientation when shifting the shiftable wall between the upper and lower positions. The bolt is movable outwardly to a locked orientation with the head of the bolt secured into an aperture in the fixed adjacent corner posts when it is desired to maintain the shiftable in the upper secure orientation with a child sleeping in a crib.

The present invention is designed for families that are short on sleeping room for their small children. It allows one small child and one baby to sleep in bunk bed style, with the crib on top, 25 inches above the youth bed. Bunk beds for children are commonplace, however, the bed and crib combination is very unusual.

The present invention features a wooden crib frame measuring 56 inches long by 28 inches wide by 7¼ inches high. The crib has a series of 46⅝ inch diameter wooden dowels supported by 1½ inch by 1½ inch frame boards on all four sides. One of the long sides of this frame is mounted on two ⅝ inch diameter dowels which allow it to slide down so that it acts as a gate. The gate is secured when in the top position by two 4 inch bolt locks. The other three sides are secured to the four outer posts with 2 inch corner plates.

The youth bed positioned on the bottom has a frame of the same size as the crib on cop. The whole structure is supported by 4 inch by 4 inch wood posts attached to the bed frames with ⅜ inch chrome carriage bolts. Both mattress support boards are made from ⅜ inch thick OSB boards. The bottom youth bed has ⅜ inch dowels across the top edges of the long sides, which are embedded in the corner posts and are used to hold curtains.

Alternatively, 2 inch by 4 inch posts can be used to allow the unit to pass through a standard door without being disassembled. With the 4 by 4 posts, the unit will have to be disassembled, but it comes apart easily. The 4 by 4 posts make the structure more sturdy. If desired, a ladder can be provided so that the crib can be used as a youth bed in later years. With its ability to convert the top bed back and forth from a crib to a child's bed, the present invention offers parents a great degree of flexibility.

As to the manner of usage and operation of the present invention, the same, should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved bed assembly with a youth bed beneath and crib above comprising, in combination:

four corner posts each having an upper extent and a lower extent, the corner posts including apertures, the corner posts being positioned in a vertical orientation to define a rectangular space therebetween; the rectangular space having a lower region for a youth bed and an upper region for a crib positioned above the youth bed;

lower planks being coupled to the posts adjacent to the lower extents thereof, the lower planks including long side walls with interior surfaces and a short head and foot wall, with support rails facing each other on the interior surfaces of the long side walls and a plurality of removable slats positioned thereon;

intermediate planks coupled with respect to the posts adjacent at an intermediate location, the intermediate planks including long side walls and a short head and foot wall, with support rails facing each other on the interior surfaces of the long side walls and a plurality of removable slats positioned thereon;

upper rails being fixedly secured to the four corner posts adjacent to the upper extents thereof vertically extending dowels secured between the upper rail and the intermediate planks to define three fixed sides of the crib;

a vertically shiftable wall including an upper edge and a lower edge, the vertically shiftable wall being positionable in an upper orientation to define a safe crib; the shiftable wall having an upper horizontal post, a lower horizontal post and vertical dowels therebetween, the lower horizontal post having two ends, a pair of guiding eyelets extending outwardly from the upper edge and the lower edge of the shiftable wall;

support eyelets facing inwardly from the corner posts in the region receiving the shiftable wall;

a pair of rods fixedly secured to the support eyelets and slidably receiving the sliding eyelets in reciprocating relationship therewith; and slidable locking bolts being secured to each end of the lower horizontal post of the shiftable wall, the bolts being slidable into a locked orientation within the apertures of the adjacent corner posts.

2. A bed assembly with a youth bed beneath and crib above comprising:

a plurality of corner posts each having an upper extent and a lower extent, the corner posts including apertures, the corner posts being positioned in a vertical orientation to define a rectangular space therebetween; the rectangular space having a lower region for a youth bed and an upper region for a crib positioned above the youth bed;

lower planks being coupled to the posts adjacent to the lower extents thereof, the lower planks including long side walls with interior surfaces and a short head and foot wall, with support rails facing each other on the interior surfaces of the long side walls;

intermediate planks coupled with respect to the posts adjacent at an intermediate location, the intermediate planks including long side walls and a short head and foot wall, with support rails facing each other on the interior surfaces of the long side walls;

upper rails being fixedly secured to the plurality of corner posts adjacent to the upper extents thereof;

vertically extending dowels secured between the upper rail and the intermediate planks to define three fixed sides of the crib;

a vertically shiftable wall including an upper edge and a lower edge, the vertically shiftable wall being positionable in an upper orientation to define a safe crib, the shiftable wall having an upper horizontal post, a lower horizontal post and vertical dowels therebetween, the lower horizontal post having two ends, a pair of guiding eyelets extending outwardly from the upper edge and the lower edge of the shiftable wall;

support members facing inwardly from the corner posts in the region receiving the shiftable wall; and a pair of rods fixedly secured to the support eyelets and slidably receiving the sliding eyelets in reciprocating relationship therewith.

3. The apparatus as set forth in claim 2 and further including:

slidable locking bolts being secured to each end of the lower horizontal post of the shiftable wall, the bolts being slidable into a locked orientation within the apertures of the adjacent corner posts.

* * * * *